US009017228B2

(12) United States Patent
Hodges

(10) Patent No.: US 9,017,228 B2
(45) Date of Patent: Apr. 28, 2015

(54) STABLE MULTI-PURPOSE EXERCISE AND TRAINING DEVICE

(76) Inventor: Jeremy Hodges, Duluth, GA (US)

( * ) Notice: Subject to any disclaimer, the term of this patent is extended or adjusted under 35 U.S.C. 154(b) by 93 days.

(21) Appl. No.: 13/152,877

(22) Filed: Jun. 3, 2011

(65) Prior Publication Data

US 2012/0309594 A1 Dec. 6, 2012

(51) Int. Cl.

| | |
|---|---|
| ***A63B 69/22*** | (2006.01) |
| ***A63B 69/24*** | (2006.01) |
| ***A63B 69/20*** | (2006.01) |
| ***A63B 71/02*** | (2006.01) |

(52) U.S. Cl.

CPC ..... *A63B 69/201* (2013.01); *A63B 69/205* (2013.01); *A63B 71/023* (2013.01); *A63B 2071/026* (2013.01); *A63B 2225/093* (2013.01)

(58) Field of Classification Search

USPC ..... 482/83–90, 104, 54, 69, 86, 87; 473/441–445, 415, 422, 423, 426, 430; 119/117; 254/4 R, 4 B, 113, 120, 325; 269/17

See application file for complete search history.

(56) References Cited

U.S. PATENT DOCUMENTS

| | | | | |
|---|---|---|---|---|
| 2,625,202 | A * | 1/1953 | Richardson et al. | 482/68 |
| 4,441,706 | A * | 4/1984 | Korzaniewski | 482/102 |
| 4,491,316 | A * | 1/1985 | Prince | 482/90 |
| 4,557,478 | A * | 12/1985 | Levine | 482/89 |
| 4,639,979 | A * | 2/1987 | Polson | 482/107 |
| 5,503,389 | A * | 4/1996 | Campbell | 473/430 |
| 5,624,362 | A * | 4/1997 | Wilson | 482/139 |
| 5,863,278 | A * | 1/1999 | Chen | 482/83 |
| 6,672,979 | B2 * | 1/2004 | Brenneisen | 473/430 |
| 6,884,189 | B2 * | 4/2005 | Fair | 473/483 |
| 7,238,127 | B2 * | 7/2007 | Al-Harbi | 473/426 |
| 7,658,699 | B1 * | 2/2010 | Johnson, Jr. | 482/87 |
| 2004/0110607 | A1 * | 6/2004 | Crespo | 482/89 |
| 2006/0025285 | A1 * | 2/2006 | Giusti | 482/83 |

* cited by examiner

*Primary Examiner* — Stephen Crow
*Assistant Examiner* — Nyca T Nguyen
(74) *Attorney, Agent, or Firm* — Merchant & Gould

(57) ABSTRACT

Aspects of the invention include providing a mixed-use training device that solves a number of problems with the prior art by providing for a dynamically adjustable height setting for weight bags and allowing for a greater radius of clearance and movement around the training device which allows the user the ability to perform a more diverse training regimen, without requiring the constant re-configuration of the training device. Weights secured to weight support members increase the stability of embodiments.

7 Claims, 8 Drawing Sheets

STABLE MULTI-PURPOSE EXERCISE AND TRAINING DEVICE

BACKGROUND OF THE INVENTION

Exercise and training devices currently found on the market have a number of problems which are solved by the present invention. First, known training devices capable of holding punching bags of various weights and size make it difficult, if not impossible, to dynamically adjust the heights of the different bags which may be attached thereto. For example, in a exemplary prior art system, a fixed-length strap, cord, or chain hangs from a connector on an extended top member of the prior art machine and attached to a connector typically found on the top of the weight bag. To adjust the height of the weight bag, the weight bag must be physically removed from the fixed-length strap. The strap must be subsequently removed from the prior art machine. A new strap of desired length must then be attached to the prior art machine and the weight bag must be lifted by the user and attached to the hanging end of the newly added fixed-length strap.

One major problem of this prior art machine is that typical weight bags can weigh up to 200 lbs. This makes physically removing the weight bag, replacing the fixed-length straps, and re-lifting the weight bag to reattach to the new strap difficult or impossible for many users, particularly women and children. If a user is not able to lift the full weight of the weight bag, they are unable to adjust the height of the bag, thus greatly limiting the uses and applications of the training device.

Another major problem of these prior art machines is the difficulty in changing the height of a weight bag during a workout session. Many mixed martial arts fighters and participants in other sports wherein punching and kicking are both employed require the ability to quickly adjust both heavy weight bags and speed bags to both high and low locations during any given workout session. Prior art machines require the cumbersome process described above each time the user wishes to change the weight bag height. Furthermore, speed bags are typically attached with straps to the top and the bottom of the prior art training machines. Thus, two straps are required to be replaced each time the user wishes to adjust weight bag height.

A separate problem created by prior art systems is the lack of space for a user of the training device in which to move and perform various methods of training. A typical prior art device has multiple support members extending out from the base to handle the support of the device. This does not create any problems for a user that is simply performing punching exercises wherein their feet are relatively stationary. However, for users wishing to train for sports, such as mixed martial arts, that require more movement and employ kicking as well as punching, the prior art devices interfere with movement of the feet and provide an extremely limited radius around the weight bag for exercises to be performed. This can be especially restrictive for a user that wishes to include kicking in his or her routine.

An additional problem created by prior art systems is the lack of stability for the training device during various methods of training. A typical prior art device has multiple support members extending out from the base to handle the support of the device. Such instability can be distractive to a workout routine as well as dangerous when a heavy bag is in use.

SUMMARY OF THE INVENTION

Aspects of the invention include providing a mixed-use training device that solves a number of problems with the prior art described above by providing for a dynamically adjustable height setting for weight bags and allowing for a greater radius of clearance and movement around the training device which allows the user the ability to perform a more diverse training regimen, without requiring the constant reconfiguration of the training device.

DETAILED DESCRIPTION

Figure 1:
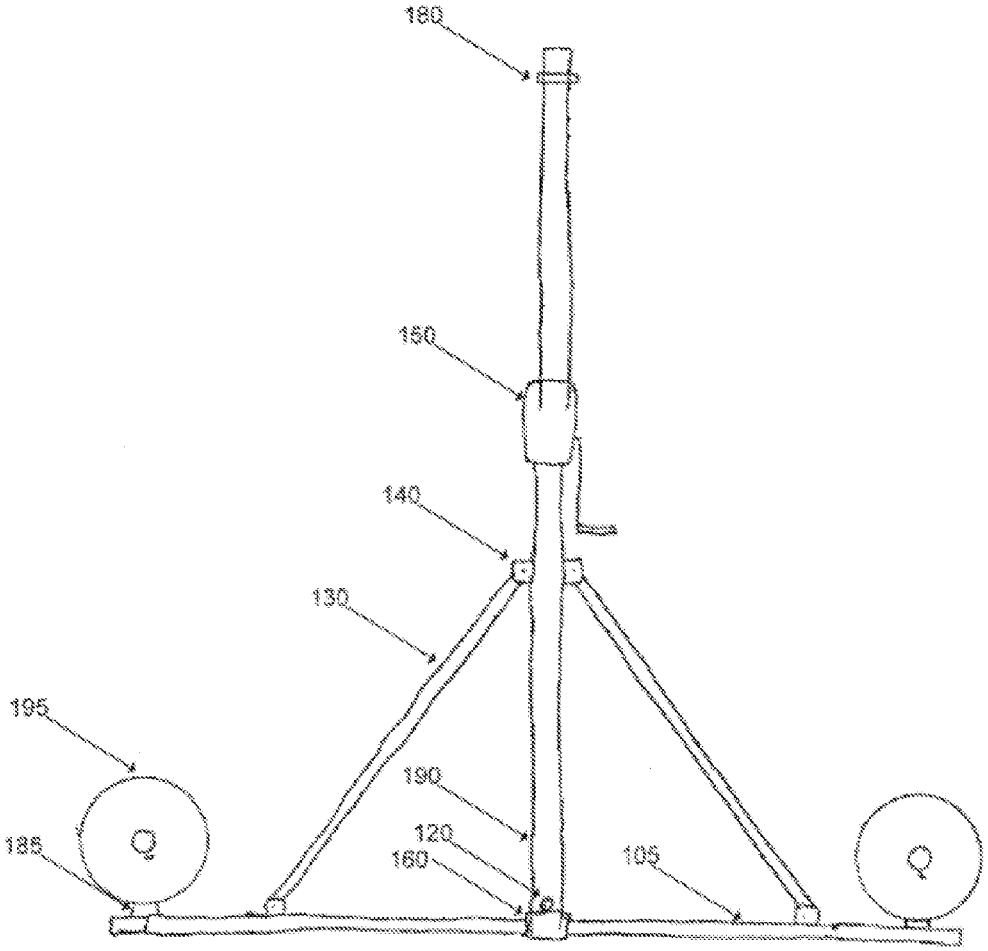
FIG. 1 illustrates embodiments of the present invention.

FIG. 1 is a frontal sketch view in accordance with embodiments of the present invention. In the illustrated embodiment, the training device is comprised of a number of components, many of which are illustrated at this angle. The base of the training device may be comprised of a steel beam 105. It should be noted that beam 105 may be comprised of any suitable metallic or other compound capable of supporting the weight of the training device. Beam 105 may be attached to two connecting support members 130. The connecting support members 130 may be connected to the beam 105 with a suitable bracket 115. The bracket 115 may be any suitable connection bracket known in the art.

The connecting support members 130 may connect using similar brackets 140 to a main support member 190. Extending out from the base of a main support member 190 is an outward bottom support member 160. A rubber pad, or other suitable device may be connected to the floor end of the outward bottom support member 160 to provide suitable traction against a floor surface.

Visible from the front view is bottom connector 120, which is described in greater detail later. Bottom connector 120 is for use with speed bags and other weight training bags that require a top and bottom connector on the training device for proper use. For example, a strap may be connected to the bottom connector 120 and the bottom of a speed bag.

A pulley and associated crank 150 is illustrated which may be capable of lifting at least the capacity of any weight bag typically used in training. As described in further detail below, a strap made of suitable material extends from the pulley and associated crank 150 and crosses up main support member 190 through the roller guide assembly 180 to support the chosen weight bag. As illustrated the roller guide assembly 180 may be designed as such to avoid twisting or tangling of straps through the use of outwardly tapering ends. The pulley and associated crank 150 allows the weight bag to be raised or lowered to the appropriate height for the user.

For increased stability, weights 195 may be secured to weight support members 185. In embodiments weights 195 may be secured to weight support members 185 by the use of weight clips as is known in the art.

Figure 2:
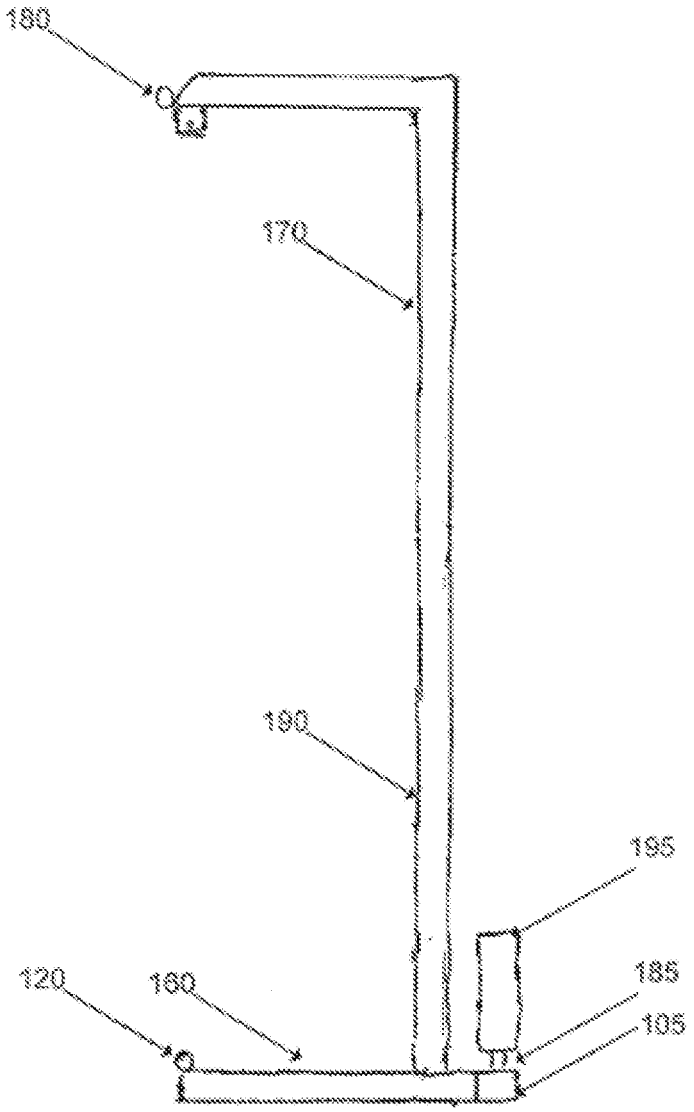
FIG. 2 illustrates embodiments of the present invention.

FIG. 2 shows a side sketch view in accordance with embodiments of the present invention. In addition to the device elements illustrated in FIG. 1, the side view in FIG. 2 additionally illustrates the positioning of beam 105 in relation to main support member 190 to increase the weight the training device can support overall. Beam 105 is set back from main support member 190, such that the weights 195 may be more effective at stabilizing the device.

Figure 3:
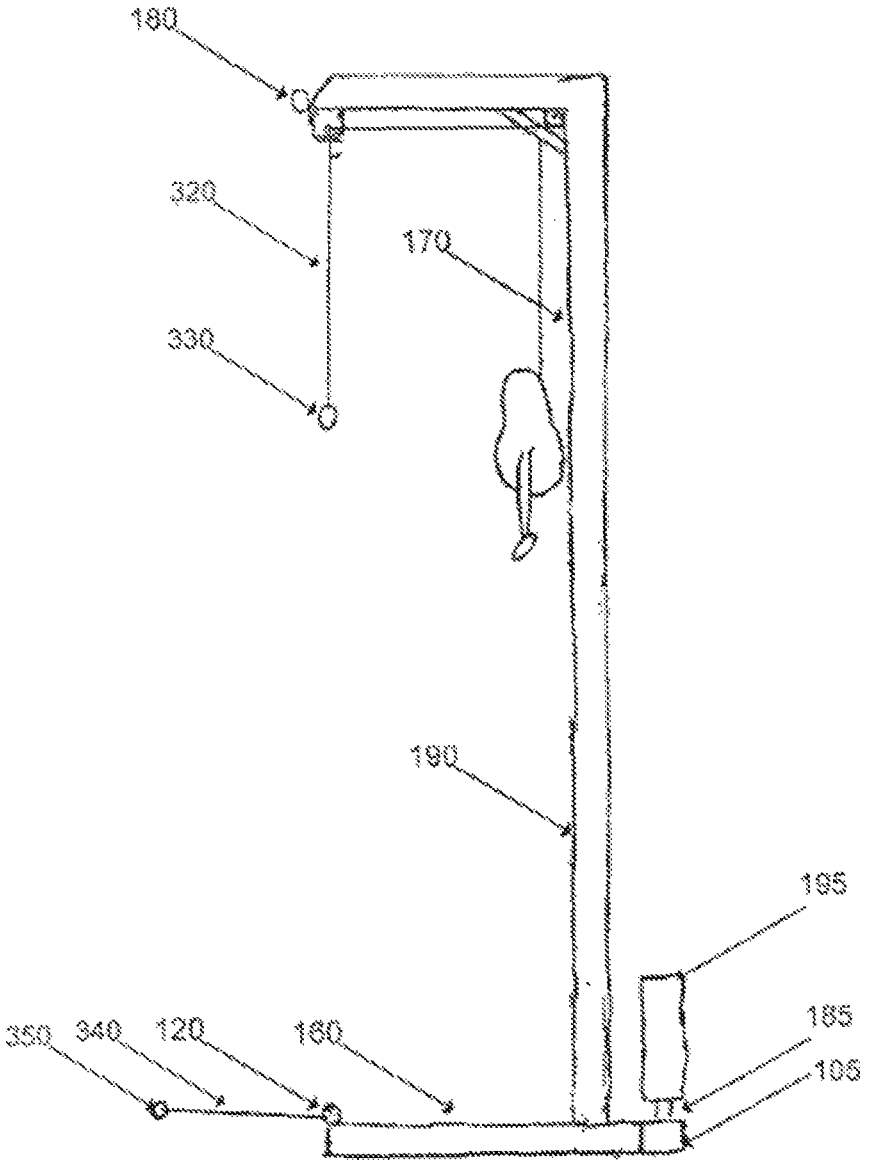
FIG. 3 illustrates embodiments of the present invention.
Figure 4:
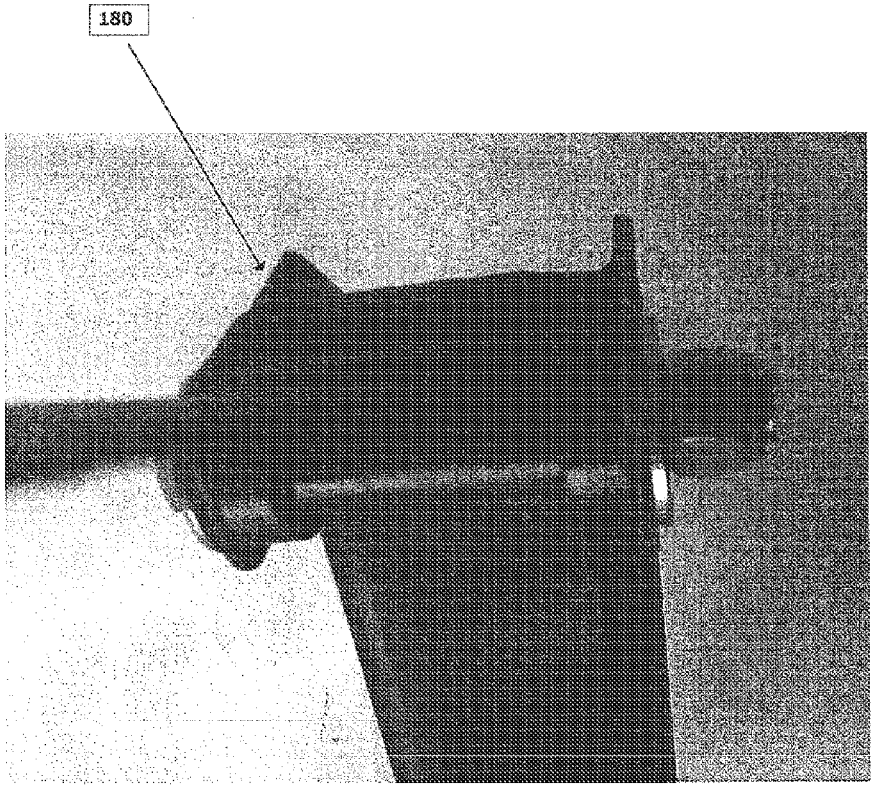
Figure 5:
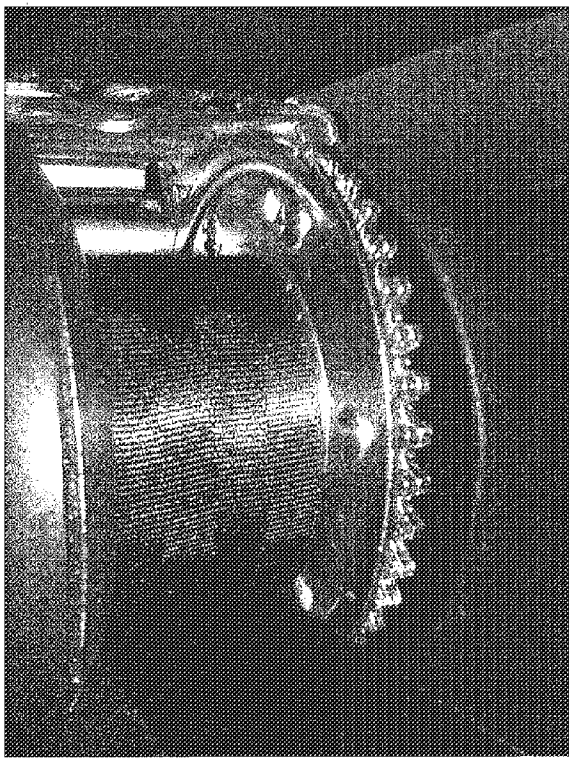
Figure 6:
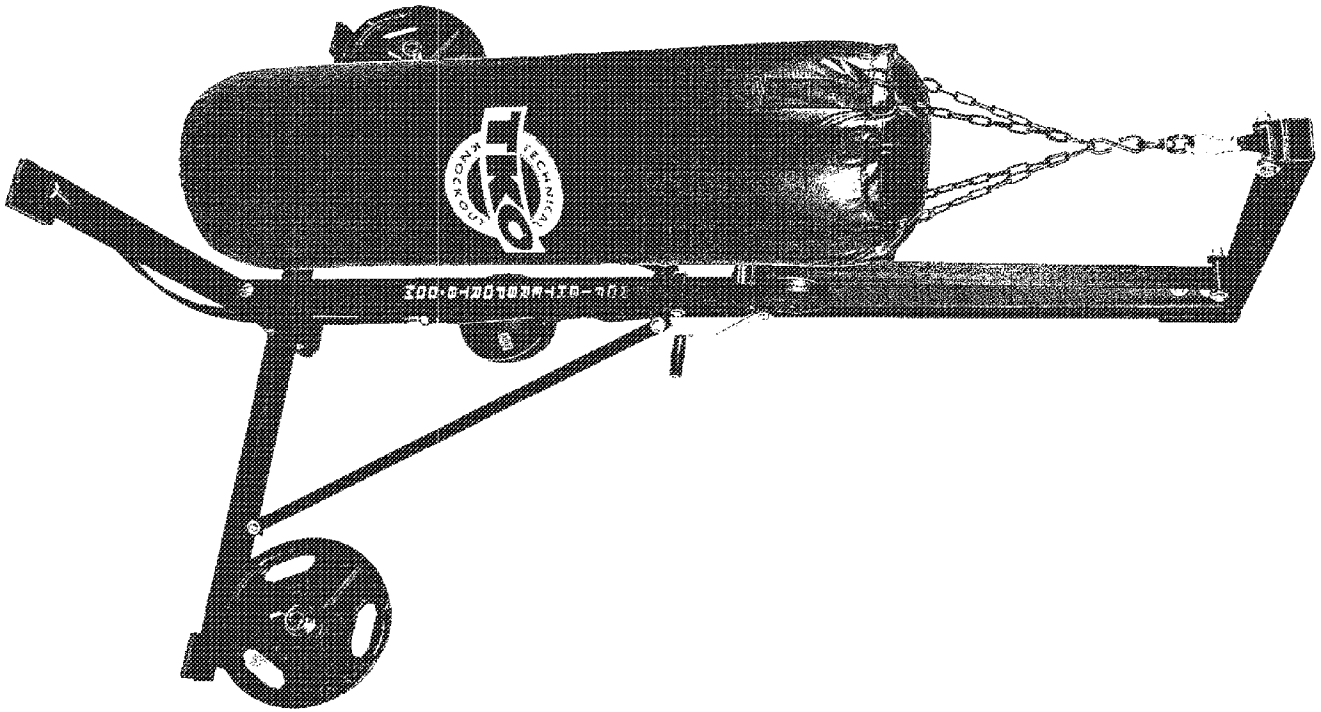
Figure 7:
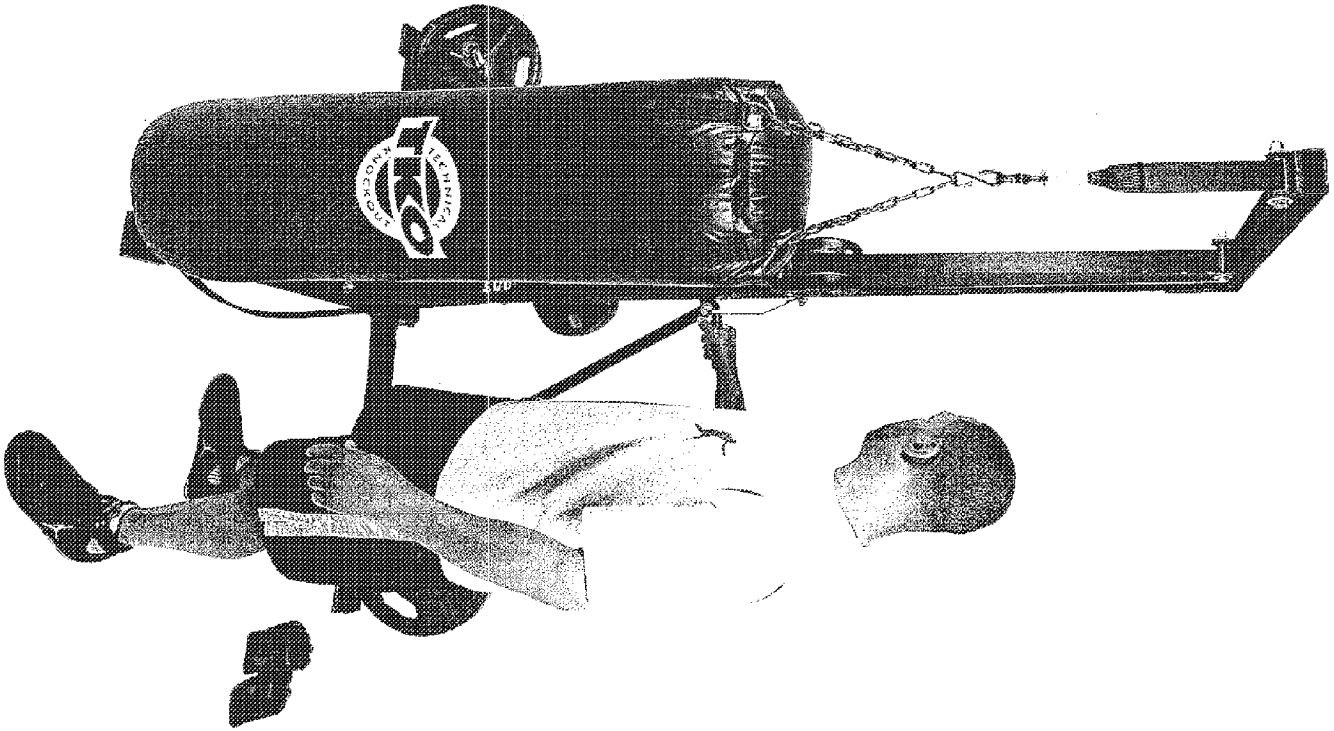
Figure 8:
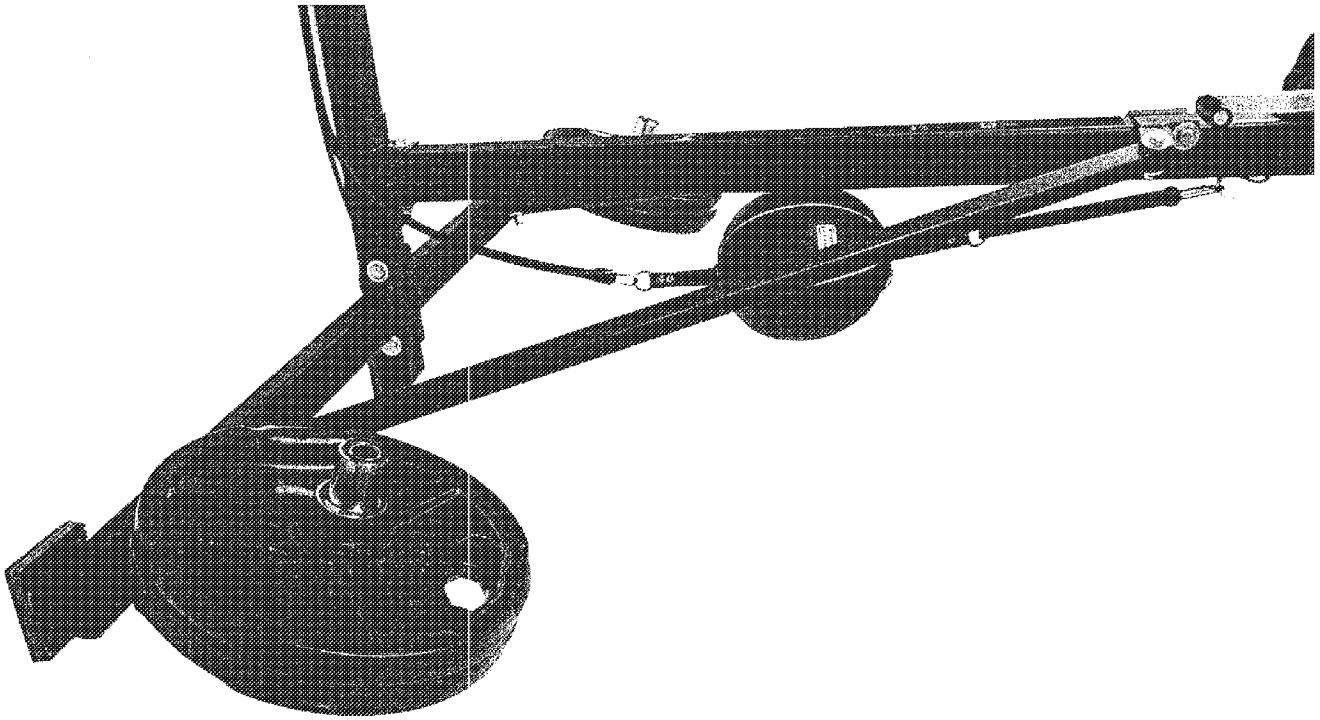

FIG. 3 shows a side sketch view in accordance with embodiments of the present invention. In addition to the device elements illustrated in FIGS. 1 & 2, the side view in FIG. 3 additionally illustrates the strap 320 which travels from the pulley and associated crank 150 through the roller guide assembly 180 until it ends with a strap connector 330 which is capable of connection to the tops of various weight bags. Similarly, strap 340 which travels from the bottom connector 120 until it ends with a strap connector 350 which is capable of connection to the bottoms of various weight bags. In some embodiments, pulley and associated crank 150 may be connected to an upper portion 170 of main support member 190.

While particular embodiments of the present invention have been described and illustrated, it should be understood that the invention is not limited thereto since modifications may be made by persons skilled in the art. The present application contemplates any and all modifications that fall within the spirit and scope of the underlying invention disclosed and claimed herein.

Alternate implementations may also be included within the scope of the disclosure. In these alternate implementations, functions may be executed out of order from that shown or discussed, including substantially concurrently or in reverse order, depending on the functionality involved. The foregoing description has been presented for purposes of illustration and description. It is not intended to be exhaustive or to limit the disclosure to the precise forms disclosed. Obvious modifications or variations are possible in light of the above teachings. The implementations discussed, however, were chosen and described to illustrate the principles of the disclosure and its practical application to thereby enable one of ordinary skill in the art to utilize the disclosure in various implementations and with various modifications as are suited to the particular use contemplated. All such modifications and variation are within the scope of the disclosure as determined by the appended claims when interpreted in accordance with the breadth to which they are fairly and legally entitled.

What is claimed is:

1. A training system comprising:

a heavy training bag;

a base support beam;

a first support member attached to a base support beam;

a second support member attached to the base support beam opposite the first support member;

a main upright support member attached to the center of the base support beam, wherein the first and second support members are attached to the main upright support member;

an outward bottom support member attached to the main upright support member, wherein the outward bottom support member extends perpendicular from the main upright support member;

a pulley attached to the main upright support member;

a first strap extending from the pulley through a roller guide assembly terminating at a strap connector, wherein the roller guide assembly is attached to a upper support member; and a second strap extending from a connector secured to the outward bottom support member, wherein the pulley comprises an associated crank that is operable to raise and lower said heavy training bag.

2. The training system of claim 1 wherein the heavy training bag is connected to the first strap.

3. The training system of claim 2, wherein the heavy training bag is connected to the second strap.

4. The training system of claim 3, wherein the heavy training bag comprises a speed bag.

5. The training system of claim 1, wherein the base support beam has a weight support member secured to each end.

6. The training system of claim 5, further comprising weights placed on each weight support member.

7. The training system of claim 6, further comprising clips to secure the weights to the weight support members.

* * * * *